US005454139A

United States Patent [19]

Beck

[11] Patent Number: 5,454,139

[45] Date of Patent: Oct. 3, 1995

[54] VACUUM CLEANER FOR VEHICLES

[76] Inventor: Ronald K. Beck, 258 Wood St., Box 164, Petersburg, Mich. 49270

[21] Appl. No.: 180,331

[22] Filed: Jan. 12, 1994

[51] Int. Cl.[6] ..... A47L 5/18

[52] U.S. Cl. ..... 15/409; 15/313; 15/414

[58] Field of Search ..... 15/409, 313, 414

[56] References Cited

U.S. PATENT DOCUMENTS

| | | | |
|---|---|---|---|
| 1,654,653 | 1/1928 | Jordanoff | 15/409 X |
| 1,783,674 | 12/1930 | Rehwold et al. | 15/409 X |
| 1,942,358 | 1/1934 | Grathwol | 15/313 X |
| 4,817,230 | 4/1989 | Kiyooka | 15/409 X |
| 5,117,531 | 6/1992 | Hentzschel | 15/409 |

FOREIGN PATENT DOCUMENTS

| | | | |
|---|---|---|---|
| 224222 | 4/1958 | Australia | 15/313 |
| 769050 | 6/1934 | France | 15/313 |
| 1141964 | 3/1957 | France | 15/313 |
| 570154 | 12/1957 | Italy | 15/313 |
| 269446 | 3/1970 | U.S.S.R. | 15/409 |
| 852287 | 10/1960 | United Kingdom | 15/313 |

*Primary Examiner*—Christopher K. Moore
*Attorney, Agent, or Firm*—Michael I. Kroll

[57] ABSTRACT

A portable vacuum generation device uses a conventional gas stream source such as is commonly available on vehicles. A specially constructed annular venturi-type nozzle pipe is capable of generating substantial vacuum from the gas stream. A removable connector for connecting the vacuum generator to the gas stream source is provided. A vacuum pipe, formed as a portion of the vacuum generator, connects to a flexible hose and conventional vacuum cleaning tools. The vacuum generator requires no moving parts and will operate in the presence of any moving gas stream. In one embodiment, the gas stream is provided by an on-board pneumatic blower. In another embodiment, the gas stream is provided by the exhaust gas stream from a vehicle internal combustion engine.

1 Claim, 1 Drawing Sheet

VACUUM CLEANER FOR VEHICLES

CROSS REFERENCE TO RELATED DISCLOSURE DOCUMENT

This invention was disclosed in Information Disclosure Document No. 326974, filed with the United States Patent and Trademark Office on Mar. 9, 1993.

BACKGROUND OF THE INVENTION

1. Field of the Invention

In accordance with conventional terminology, the term vacuum used herein may be taken to mean the presence of a static pressure less than that of the ambient atmosphere inside any receptacle or conduit. Ambient air rushes from the surroundings into any opening or nozzle in a receptacle or conduit containing a vacuum.

The present invention relates to a vacuum cleaner for vehicles. More specifically, it relates to a vacuum system for a vehicle equipped with a pneumatic blower such as used to unload dry bulk hauled in tractor-trailer tank trucks. The pneumatic blower serves as a source of pressurized high velocity air flow which, in turn, is converted into a vacuum source by my invention. The vacuum source may be attached to conventional tools (such as brushes, wands, crevice tools, etc.) for cleaning around or inside the vehicle.

In broader sense the source of the high velocity air need not be a vehicle mounted pneumatic blower. The air source could be from a stationary compressor in a factory where the cleaning could be done around the machinery. The air source could also be derived from a tank of compressed air in a remote location such as underwater. Also the vacuum created need not be used for cleaning but could be for operating any sort of vacuum operated equipment. The source of the air flow to create the vacuum and the end use for the vacuum take many forms as will be seen in the remainder of this specification. Many other fields are thus brought under the scope of the invention.

As such it will be appreciated that the potential uses are myriad. A comprehensive listing of all the possible fields to which this invention may be applied is limited only by the imagination and is therefore not provided herein. Some of the more obvious applications and end products are mentioned herein in the interest of providing a full and complete disclosure of the unique advantages to be gained by use of this hitherto unknown vacuum production device.

The transportation and manufacturing industries are seen as the fields most likely to gain immediate and substantial benefit from this invention. It is to be understood from the outset that the scope of this invention is not limited to these fields or to the specific examples of potential uses presented hereinafter.

2. Description of the Prior Art

Recently, the use of portable vacuum cleaners has become popular for cleaning the interior of vehicles. Many small units have been sold which plug into the vehicle cigarette lighter to obtain energy for an electric vacuum cleaner. However, this approach is a waste of resources. The vehicle upon which the cleaner is to be used already has the potential for developing sufficient vacuum without using any moving parts, much less using a complicated electrical motor. As taught herein, all that is necessary is the proper routing of any available high velocity gas stream.

Another approach of the prior art has been to utilize the existing vacuum developed inside the intake manifold of an internal combustion engine. This approach uses no additional parts for vacuum creation. However, the vacuum produced tends to be weak and unsuitable for vacuum cleaning. One problem is that any dust or debris collected by the cleaning head must positively be prevented from reaching the intake or a ruined engine could result. In short, a leaky ten cent vacuum cleaner bag could cost a ten thousand dollar engine. The risk is obviously not worth it.

Numerous prior patents have addressed the problem of providing a convenient vacuum source for vehicles. The following known prior art has been directed to providing such a source. As will be seen, the simplicity and effectiveness of my invention is not rivaled in the prior art.

U.S. Pat. No. 3,230,569, issued to Nielsen on Jan. 25, 1966, shows a vacuum cleaner for automobiles. The cleaner is connected to the intake manifold of the engine as discussed above. By contrast, the device of the instant invention does not require the dangerous connection to the engine intake and could conceivably be operated by the automotive exhaust gas stream.

U.S. Pat. No. 1,801,966, issued to Maddocks on Apr. 21, 1931 shows a vacuum cleaning apparatus which connects to the engine intake manifold. By contrast, the device of the instant invention does not require the dangerous connection to the engine intake and could conceivably be operated by the automotive exhaust gas stream.

U.S. Pat. No. 3,764,232, issued to Brown on Oct. 9, 1973, shows a vacuum cleaner for vehicles. The vacuum is generated by a fan in a casing clutched to an electric motor. In essence Brown has simply mounted the works of an electric vacuum cleaner on an automobile. By contrast, the device of the instant invention does not require any moving parts and may conceivably be operated by the automotive exhaust stream.

It will be noted that all the prior art devices require substantial complex equipment or a connection to the vehicle engine intake manifold to generate a vacuum. The materials required by this invention are uncomplicated, inexpensive, and highly effective at performing the intended function.

None of the above inventions and patents, taken either singly or in combination, is seen to describe the instant invention as claimed. As will be seen, the simplicity and effectiveness of my invention is not rivaled in the prior art.

SUMMARY OF THE INVENTION

Briefly, the invention comprises a conventional gas stream source, a specially constructed annular venturi-type vacuum generator capable of generating substantial vacuum from the gas stream, removable connection means for connecting the vacuum generator to the gas stream source, a vacuum pipe formed as a portion of the vacuum generator, a flexible hose connected at one end to the vacuum pipe, and conventional vacuum cleaning tools connected to the other end of the flexible hose.

The vacuum generator of the invention requires no moving parts and will operate in the presence of any moving gas stream. In the preferred embodiment of the instant invention this gas stream is provided by an on-board pneumatic blower such as is commonly present on tank trucks for transporting bulk dry powder material. It is contemplated that the invention could also be practiced using the exhaust gas stream from the internal combustion engine.

The operation of the invention is based on Bernoulli's principle. In the special case of constant temperature flow, the principle states that the product of the static pressure and the velocity of a gas flow is constant. In other words, if the velocity of a flow stream is increased its static pressure is decreased and vice-versa. If the area of a fluid flow path is reduced, the velocity of the flow must increase to maintain the same flow quantity. Thus, by restricting the flow area in a localized area the increased velocity will lead to a localized area of reduced pressure. If this reduced pressure is below ambient pressure it can be seen that the area restriction gives rise to a vacuum source. This is the same principle by which an airplane wing generates lift. The air flowing over the curved upper surface of the wing must travel at a higher velocity than that passing under the flat undersurface. This higher velocity leads to a reduced pressure on the top of the wing which generates lift.

Accordingly, it is a principal Object of the invention to provide a new and improved vacuum cleaner for vehicles which overcomes the disadvantages of the prior art in a simple but effective manner.

It is a major object of this invention to provide a new vacuum cleaner for vehicles which requires no moving parts other than those already available on an existing vehicle.

It is another object of the invention to provide such a vacuum cleaner for vehicles which is readily detachable from the existing vehicle gas expelling device be it a pneumatic blower or a vehicle exhaust pipe.

It is another object of the invention to provide the elements of the invention in the form of a kit which could be safely and easily used by any vehicle owner in need of a vacuum cleaner.

It is another object of the invention to provide a vehicular vacuum cleaner which requires no external energy except that already readily available as an engine waste product or as provided by an existing vehicle attachment.

It is another object of the invention to provide a portable vacuum source for any area having the availability of a gas flow stream, such as a factory with installed compressed air lines.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 2:
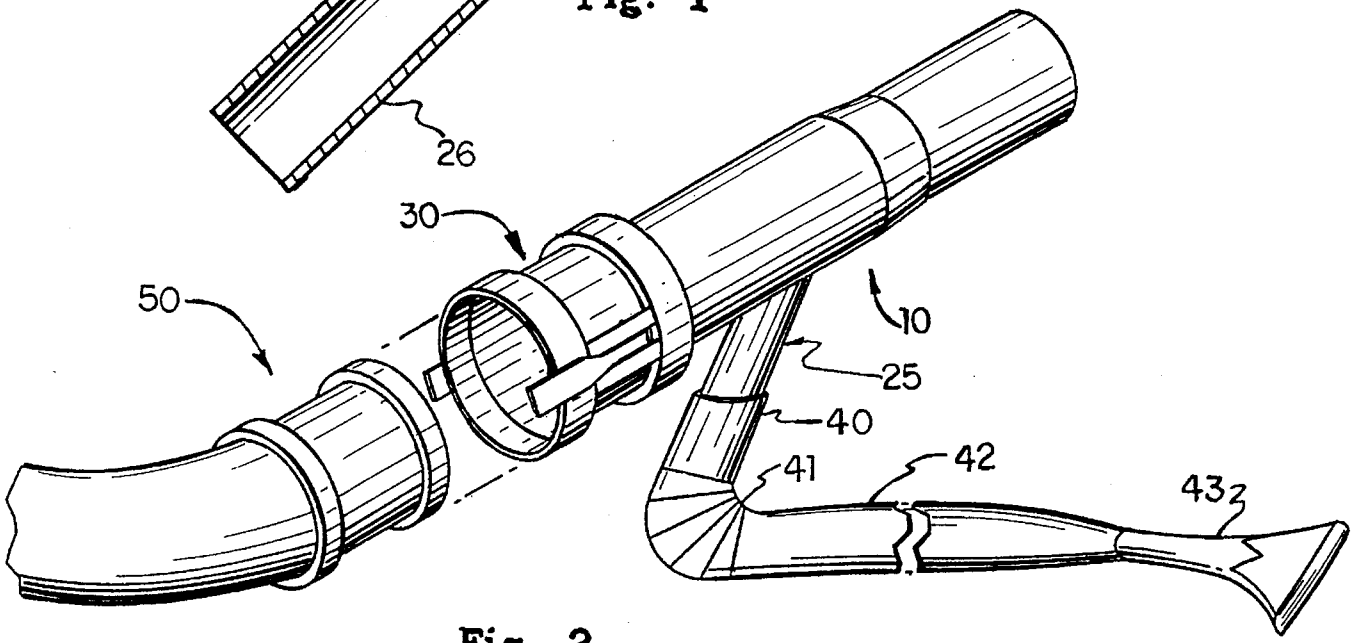
FIG. 2 is a perspective view of the invention shown disconnected from its air flow source.

The vehicle vacuum device of this invention is generally shown in FIG. 2. The new and unique portion of the device comprises a main or nozzle pipe 10, with connected vacuum pipe 25, and detachable quick connecter 30. An existing gas stream source 50 and vacuum cleaner attachments 40, 41, 42, and 43 are all conventional but used in combination with the new elements to form the overall invention.

It is to be understood that gas stream source 50 could be a vehicle exhaust pipe, or a vehicle mounted blower pipe, or any other gas stream source on or off a vehicle.

Vacuum cleaner attachments shown are flexible hose attachment 40 for sealably connecting to vacuum pipe 25, flexible accordion type hose 41 leading to optional air filter section 42, and crevice tool 43. It is to be understood that the particular connection, flexible hose, and working tool shown in the Figure are merely representative and any of a vast array of standard vacuum cleaner attachments might as well be used.

Figure 1:
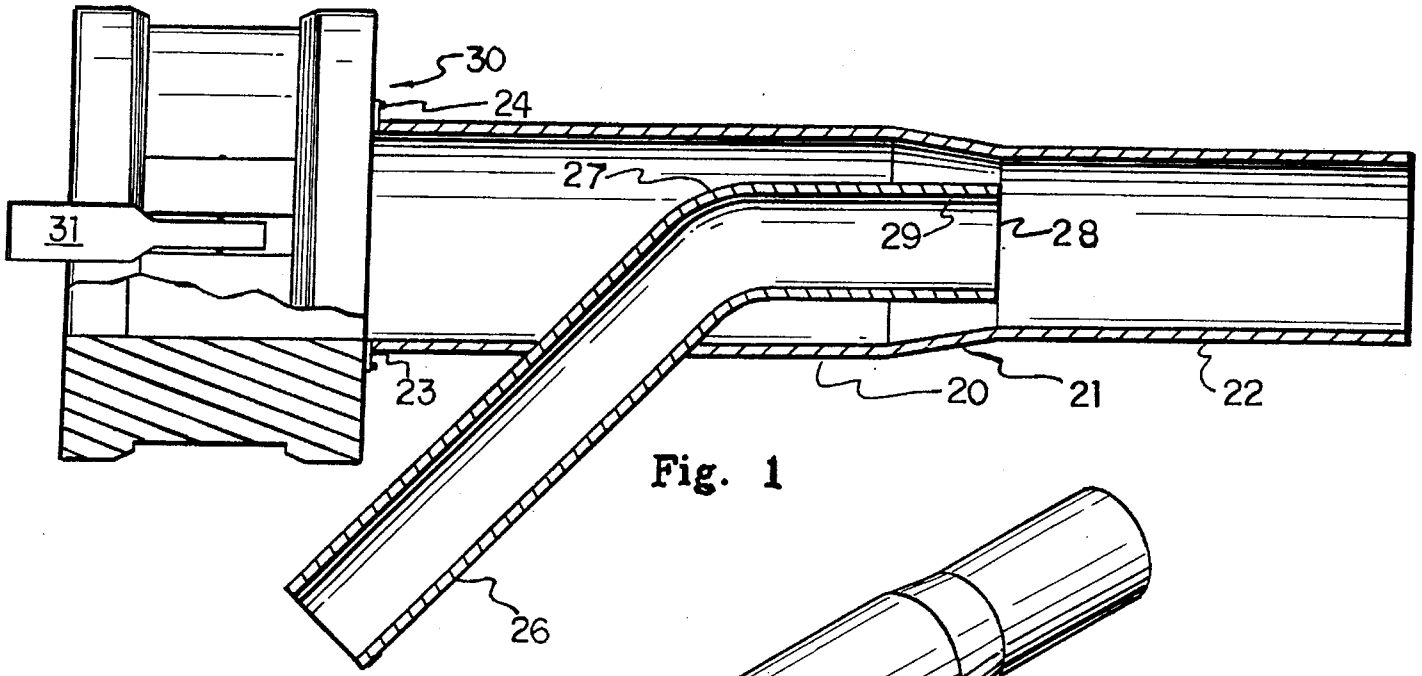
FIG. 1 is cross-sectional view of the vacuum generator of the invention taken along the length thereof with the detachable connection element shown in partial cross-section.

Turning now to FIG. 1 the internal details of the device are revealed by virtue of the cross-sectional nature of the view. The left hand portion of the Figure shows, somewhat schematically, a detachable connector 30 with locking ears 31. The internal details of the connector are not shown as any sort of conventional releasable connector for attaching to an existing pipe stub or male mating connector would be suitable for use with this invention.

It is contemplated, however, that different connectors 30 should be made available to accommodate attachment to various different types and styles of gas stream sources. For this reason, connector 30 is shown connected to flange 23 of main nozzle pipe 10 by several small bolts or screws.

Main nozzle pipe 10 includes the flange 23 which rings large diameter portion 20 of the pipe. Large diameter portion 20 merges into a smaller diameter portion 22 through a converging portion 21. This convergence into a smaller cross-sectional flow area helps cause the gas, flowing in direction of arrow A, to increase in velocity and create a vacuum condition as above described in connection with Bernoulli's principle. For maximum efficiency and minimum turbulence the internal surfaces of nozzle pipe 10 should all be smooth. The right hand end of small diameter portion 22 is preferably open to the atmosphere to allow for unrestricted flow of the gas. It is contemplated that a trash collection bin could be placed downstream from the exit end of pipe 22 to capture large items vacuumed up by the device.

Intersecting the large diameter portion 20 of nozzle pipe 10 at about a 45 degree angle is the outer section 26 of vacuum pipe 25 (see FIG. 1). The angled outer section 26 of vacuum pipe 25 extends upwardly and to the right inside nozzle pipe portion 20 to about the center line of pipe portion 20. At this point vacuum pipe 25 is bent at 27 so as to have the remaining length 29 of vacuum pipe 25 extend concentric with nozzle pipe portion 20. The centerline of stub 29 of vacuum pipe 25 is collinear with the centerline of both the large diameter and small diameter portions of nozzle pipe. Vacuum pipe 25 is cut off at end 28 which is approximately the same downstream distance as the beginning of small diameter portion 22 of nozzle pipe 10. The external surfaces of vacuum pipe 25 that are enclosed within nozzle pipe 10 should all be smooth and rounded to reduce turbulence in the air flow and increase the efficiency of vacuum production.

The operation of the device will now be discussed.

Incoming gas, flowing in the direction of arrow A, first enters nozzle pipe 10 smoothly by virtue of the fact that external flange 23 has no internal projections. In the leftmost section the gas has the entire large diameter portion of the nozzle pipe 10 for free passage. As the gas impinges upon the inserted vacuum pipe a certain amount of turbulence is created and the gas is forced to follow the annular area outside the vacuum pipe in inside large diameter portion 20 of nozzle pipe 10. The gas velocity is increased somewhat. A straight section of the annular passage thus formed is useful for straightening the flow and reducing the turbulence. If desired it is possible to place straightening vanes in this constant area annular section to further reduce the turbulence. The gas is then subjected to a further reduction in the flow area by the convergence of the nozzle pipe 10 from large diameter portion 20 to small diameter portion 22 by the conically shaped pipe section 21. At cut off end 28 of vacuum pipe 25 the flow area is the smallest and the gas velocity is thus the highest in its entire transit. This high velocity leads to a very low pressure by Bernoulli's principle and this low pressure is at the cut off end 28 of vacuum pipe 25. The vacuum in pipe 25 is then available for use as with conventional vacuum cleaning tools. Of course other uses could be made of the vacuum such as driving a linear vacuum actuator.

I have found the vacuum produced by this device to be more than adequate for cleaning purposes when the source air flow is provided by a pneumatic blower. It is contemplated the vacuum could also be made adequate using a flow source of a conventional vehicle exhaust if certain refinements were incorporated into the device. First, it is well known that exhaust gas is a considerably higher temperature than the surroundings. I would propose to take advantage of that hot gas in the following manner. If the temperature of a flowing gas is reduced during flow the net effect is to further increase the velocity and decrease the pressure. Therefore, the vacuum producing effects of the device can be enhanced by cooling the exhaust gas as it passes through the nozzle pipe. This cooling could be enhanced by appropriate cooling vanes on the nozzle pipe and the enclosed portion of the vacuum pipe, both inside and outside. Other potential improvements in vacuum producing efficiency could be made by shaping and forming all airflow passageways into efficient air foil shapes. For example, the portion of vacuum pipe 26 which is internal to the nozzle pipe could be teardrop shaped rather than round.

A list of reference numerals for the first embodiment of the present invention follows:

10 main nozzle pipe
20 large diameter portion of nozzle pipe
21 converging portion of nozzle pipe
22 small diameter portion of nozzle pipe
23 connection flange of nozzle pipe
24 connecting bolts or screws
25 vacuum pipe
26 external straight portion of vacuum pipe
27 internal bend portion of vacuum pipe
28 internal cut off end of vacuum pipe
29 internal concentric stub end of vacuum pipe
30 detachable quick connector
31 locking ears
36 safety bottom cap
40 vacuum cleaner hose attachment
41 accordion type flexible hose
42 filter section of vacuum cleaner
43 standard vacuum cleaning tool
50 conventional air stream source It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily see how the shown intersecting circular pipes could just as well be ellipsoidal or even polyhedral.

It is to be understood that the present invention is not limited to the sole embodiment described above, but encompasses any and all embodiments within the scope of the following claims:

I claim:

1. An improved vacuum production device for using vacuum cleaning tools with a vehicle having a gas stream source comprising:

vacuum generation means capable of generating substantial vacuum from the gas stream source and being formed as a nozzle pipe having a large diameter portion merged into a small diameter portion through a conical subportion;

removable connection means for connecting said vacuum generation means to the gas stream source, said nozzle pipe being straight along its entire length from said connection means;

a vacuum pipe inserted at about a 45 degree angle into said nozzle pipe upstream of said conical subportion, said vacuum pipe being bent to form a straight subsection of uniform diameter along its complete length and concentric with said nozzle pipe, said vacuum pipe being of smaller diameter than said small diameter portion of said nozzle pipe and terminating at the downstream end of said conical subportion where said small diameter portion of said nozzle pipe begins so as to form a minimum flow area for the gas stream in the nozzle pipe at the outlet of said vacuum pipe, said vacuum pipe being rounded where said vacuum pipe is bent within said nozzle pipe to reduce turbulence within said nozzle pipe and having a straight external section having means for connection of the vacuum cleaning tools.

* * * * *